United States Patent [19]

Gluntz

[11] 3,992,076

[45] Nov. 16, 1976

[54] CIRCUIT BOARD SOCKET

[75] Inventor: Glenn Harlan Gluntz, Harrisburg, Pa.

[73] Assignee: E. I. Du Pont de Nemours and Company, Wilmington, Del.

[22] Filed: June 10, 1975

[21] Appl. No.: 585,467

[52] U.S. Cl. ..... 339/258 R; 339/275 B

[51] Int. Cl.[2] ..... H01R 13/12

[58] Field of Search ..... 339/17, 258, 259, 262, 339/275

[56] References Cited

UNITED STATES PATENTS

| | | | |
|---|---|---|---|
| 2,917,723 | 12/1959 | Gluck | 339/275 B |
| 3,156,517 | 11/1964 | Maximoff et al. | 339/275 B |
| 3,718,895 | 2/1973 | Reynolds et al. | 339/258 R |
| 3,609,640 | 9/1971 | Longenecker et al. | 339/258 P |
| 3,713,080 | 1/1973 | Kennedy | 339/258 R |
| 3,717,841 | 2/1973 | Mancini | 339/258 R |
| 3,781,770 | 12/1973 | Mancini | 339/259 R |

*Primary Examiner*—Joseph H. McGlynn

[57] ABSTRACT

A circuit board socket having a square hollow body, a pair of folded cantilever springs extending from one end of the body, the cantilever springs having divergent first arms, bight portions and convexly bowed second arms extending back into the interior of the body with contact surfaces normally engaging each other within the body, legs on the other end of the body for mounting the socket on and subsequent soldering to a printed circuit board, a tab closing the other end of the body adjacent the legs integral with the body and a seam extending along one side of the body and partially around the tab.

7 Claims, 7 Drawing Figures

CIRCUIT BOARD SOCKET

This invention relates to circuit board sockets of the type conventionally mounted on a circuit board in electrical connection with circuitry on the board for forming an electrical connection with a lead or like element which is inserted into the body of the socket. The circuit board socket may be mounted in an insulating housing which supports the sockets and aids in locating a number of sockets in proper position for mounting on the circuit board and receiving spaced leads extending from a circuit element, such as an integrated circuit module. The electrical connection between the socket and the lead is of the disconnect type so that the lead may be removed from the socket if desired. This would be the case, for instance, if the electronic components within the integrated circuit module fail and the failed module must be replaced by a new module.

The electronics industry requires that circuit board sockets must be extremely reliable. They must withstand repeated insertion and removal of leads without impairment of the electrical contact between the lead and the socket. The sockets must be easily soldered to the circuit board without damage to the electrical connection between the lead and the socket, whether established before or after soldering.

Prior art U.S. Pat. No. 3,609,640 and 3,718,895 disclose sockets of the type adapted to be solder-mounted on a circuit board for establishing electrical connections between circuitry on the board and leads inserted into the sockets. The socket of the present invention represents an improvement over these prior art sockets in a number of respects described more fully in the following disclosure.

Accordingly, it is an object of the invention to provide an improved circuit board socket.

Another object is to provide a circuit board socket having folded cantilever springs with an increased target area for receiving a lead inserted into the body and having improved spring characteristics.

A further object of the invention is to provide a circuit board socket where the lead withdrawal force is more nearly equal to the insertion force than in conventional sockets and where an increased wipe is provided.

Another object of the invention is to provide a circuit board socket with an improved construction for preventing molten flux or solder from flowing up into body of the socket during the soldering operation by which the socket is mounted on the circuit board in electrical connection with the circuitry on the board.

Other objects and features of the invention will become apparent as the description proceeds, especially when taken in conjunction with the accompanying drawings illustrating the invention, of which there is one sheet.

IN THE DRAWINGS

Figure 5:
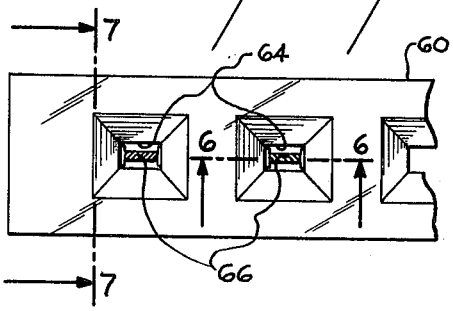
Figure 6:
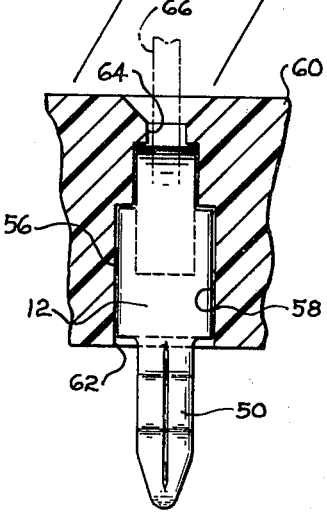
Figure 7:
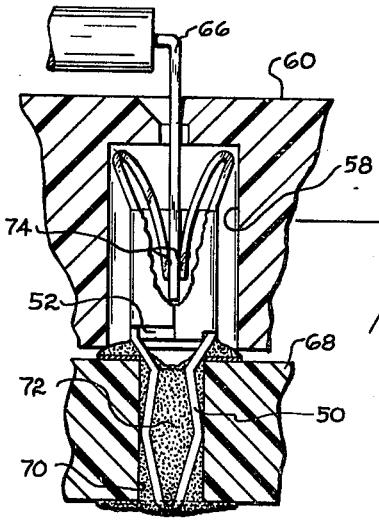

FIG. 5 is a top view of a block carrying a number of circuit board sockets as disclosed herein; and FIGS. 6 and 7 are sectional views taken along lines 6—6 and 7—7 respectively of FIG. 5.

Circuit board socket 10 is preferably stamp-formed from uniform thickness conductive metal stock and includes an elongate rectangular body 12 having flat sides 14, 16, 18 and 20 extending along the length of the body and joined at corners 22, 24, 26 and 28. Seam 30 extends along the length of side 20 away from corners 22 and 24 to divide the side into two side portions 32 and 34. A pair of folded cantilever springs 36 and 38 extend from opposed sides 14 and 18 of the body at the upper open end as illustrated in FIG. 1.

Each folded spring includes a straight first arm 40, a bight or reverse bend 42 at the end of the first arm, and an extended second arm 44 having a free end 46 positioned within the interior of body 12. First arms 40 diverge away from each other at a shallow angle as illustrated in FIGS. 1 and 7. The bights 42 are located at the ends of the first arms away from the body and are bent around in a direction toward the adjacent opening in the body through an angle of slightly less than 180° . The second arms 44 extend away from the bights in directions slightly divergent from the axes of the straight first arms 40 and are bowed convexly inwardly along their lengths toward each other. The folded cantilever springs 36 and 38 are preloaded so that the contact ends 46 thereof normally are biased against each other, as shown in FIG. 1.

In some situations, the socket may be stamp-formed by an operation leaving burrs at the adjacent corners of free ends 46. In this event, a chamfer 48 is provided on the corner of each of second arms 44 in order to move the burr. Such burrs are undesirable as they scrape the surfaces of leads inserted into the socket body.

Figure 1:
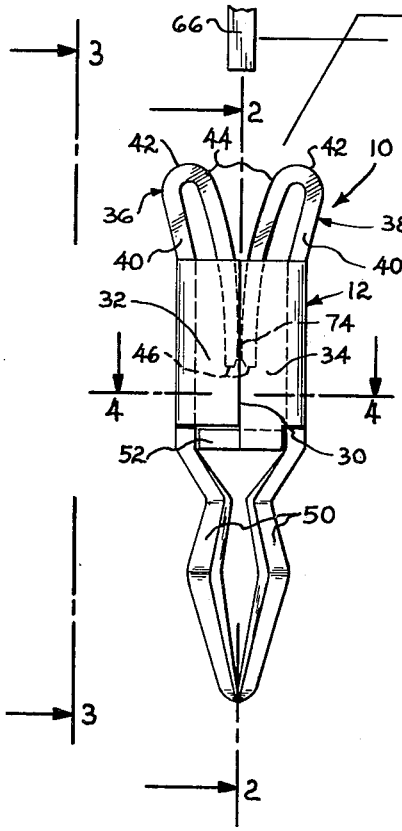
FIG. 1 is a side view of a circuit board socket according to the invention.
Figure 2:
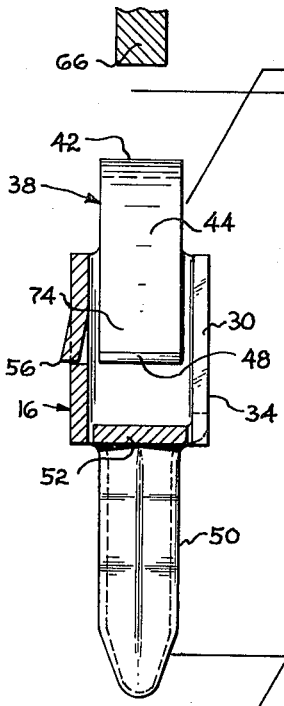
FIG. 2 is a sectional view taken along line 2—2 of FIG. 1.

A pair of mounting legs 50 extend away from body sides 14 and 18 at the lower end of the body as illustrated in FIG. 1. Legs 50 facilitate mounting the socket in a circuit board hole as illustrated in FIG. 7 for subsequent soldering and establishment of an electrical connection with the printed circuitry on the board.

Figure 3:
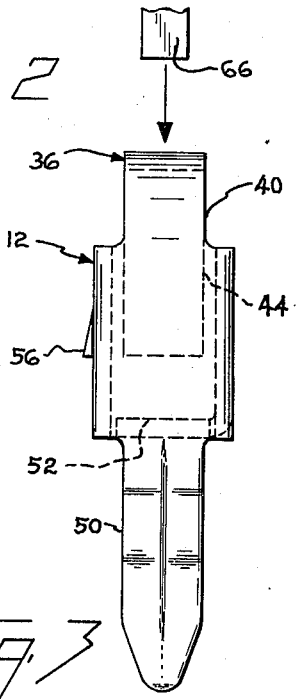
FIG. 3 is a view taken along line 3—3 of FIG. 1.
Figure 4:
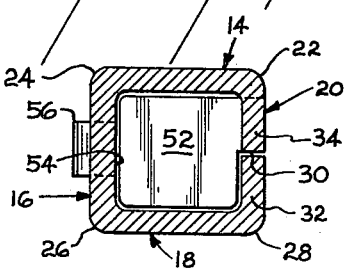
FIG. 4 is a sectional view taken along line 4—4 of FIG. 1.

As illustrated in FIGS. 1, 3 and 4, the opening at the lower end of body 12 is closed by a tab 52 which is integral with body side portion 34. Seam 54 is an extension of seam 30 and runs from the end of seam 30 partially around the tab 52 past the interior surfaces of side portion 32, and of side walls 16, 18 and 14. Tab 52 aids in preventing flux and molten solder from wicking into the interior of the body. A retention tab 56 projects outwardly from side wall 16 for securing the socket in a cavity in an insulating housing.

Circuit board sockets 10 may be mounted in cavities 58 formed in an insulating housing 60 as illustrated in FIGS. 5, 6 and 7. Each socket is inserted into a cavity through an opening 62 and is secured in the cavities by retention tab 56 which bites against the side of the cavity. A lead-receiving opening 64 communicates with each cavity 58 and is located on the axis of the socket in the cavity so that a lead 66 inserted through opening 64 is guided into the interior of the socket body between the pair of folded cantilever springs 36 and 38. The opening 64 is preferably somewhat larger than the transverse cross section of the lead 66 to permit insertion of leads which are not exactly aligned with the axis of the socket. resultant solder points 72 establish electrical connections between the sockets 10 and printed circuitry on the board.

The interior surfaces of the body 12 and legs 50 adjacent tab 52 of each socket may be coated with a solder resist material to assist in the prevention of wicking of molten flux and solder into the interior of the body. Tab 52 closes the end of the body adjacent the legs and reduces the possibility of molten flux and molten solder from wicking into the body during the fluxing and soldering operation. Wicking of either flux or solder into the interior of the socket body adversely effects the electrical properties of the socket.

After housing 60 has been mounted onto the circuit board with the sockets held therein in electrical connection with the circuitry on the board, leads 66 may be inserted through openings 64 and into the sockets to establish electrical connections with the circuitry on the board. As a lead is moved toward a socket, it engages the bowed second arms 44 and, with further movement toward the body, forces the springs 36 and 38 apart gradually to stress and collapse the springs as illustrated in FIG. 7. During collapse of the springs, all three portions, straight arms 40, bights 42 and bowed second arms 44 are stressed within their elastic limits and contribute to the contact force between the ends of the springs and the lead. When the end of the lead is moved past ends 46 of the springs the springs are fully stressed and the flat contact surfaces 74 at the ends 46 of the folded cantilever springs are flush upon the sides of the lead establishing an electrical connection between wiped surfaces on the lead and both arms.

The inwardly convexly bowed legs 44 of the cantilever springs assure that the work of stressing the entire cantilever springs during insertion ofthe lead is spread over an insertion distance longer than the insertion distance in a socket having conventional straight cantilever springs as shown in U.S. Pat. No. 3,609,640 and 3,718,895 , thereby reducing the insertion force required to move the lead into the socket without a reduction of the resultant normal force between the springs and the lead. The wipe distance between the spring and the lead is increased.

The bowed configuration of the second arm 44 increases the binding force between the arms and lead when the lead is subject to a withdrawal force, the second arms acting as over-center cams. This tendency increases the force required to withdraw the lead from the socket and helps to assure that the lead is confined in the socket against accidental shocks and forces which might otherwise remove the lead from the socket. The smoothly bowed second arms are stressed along their lengths.

First cantilever spring arms 40 diverge away from each other and from the body side walls 16 and 20. The lead-receiving space between the second arms 44 is increased over that provided in conventional sockets where springs are folded into the interior of the socket body from the side of the body. The increased size of the lead target provided by arms 44 facilitates reception of leads which are not exactly aligned on the axis of the socket. For instance, the lead may be skewed, located near one folded cantilever spring than the other folded cantilever spring or twisted somewhat with respect to the socket.

Tab 52 is shown as being integral with side portion 34 of socket side 20. It is contemplated that the tab may be formed as an integral portion of socket side 16 in which case the extent of seam 54 would be reduced from that shown in FIG. 4.

In some applications, leads are inserted into a circuit board socket prior to positioning the sockets in circuit board holes and soldering the sockets to the board. In this event, tabs 52 limit over-insertion of the leads so that the ends of the leads are not exposed to flux or molten solder during subsequent soldering of the sockets.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A circuit board socket formed of conductive metal stock and comprising an elongate, hollow body having a rectangular transverse cross section; a pair of folded cantilever springs extending from opposed sides of the body at one end of the body, each spring including first and second arms, said first arms extending away from the body and diverging from each other outwardly of the body, each spring being bent back in a bight toward said one end of the body, each second arm extending from a bight back into the interior of the body, there being contact sufaces on the ends of the second arms, said pair of cantilever springs being normally stressed so that said contact surfaces engage each other within the body, the second arms being convexly bowed toward each other; a pair of circuit board mounting legs extending from opposed sides of the body at the other end of the body; and a tab integral with another side at and closing said other end of the body.

2. A circuit board socket as in claim 1 wherein said first arms are straight and said bights are bent through an angle of slightly less than 180° .

3. A circuit board socket formed of conductive metal stock and comprising an elongate hollow body; a first seam extending longitudinally along the length of the body; a pair of opposed cantilever springs extending from one end of the body and including contact surfaces within the body, said pair of springs being normally stressed with the contact surfaces thereof engaging each other within the body; circuit board mounting means extending from the other end of the body; a tab closing said other end of the body integral with a portion of the body located adjacent said first seam; and a second seam between said tab and the body forming an extension of the first seam and extending around said tab.

4. A circuit board socket as in claim 3 wherein the body is rectangular in transverse cross section to define four body sides, the first seam extends along the length of one body side, and the second seam extends along the inner surfaces of the other three body sides and partially along the inner surfaces of said one body side.

5. A circuit board socket as in claim 3 wherein each of said springs includes a first cantilever arm, a reverse bend bight and a second cantilever arm, the bights being located between the arms, and the body includes a pair of opposed flat sides, said springs extending from said sides, said first arms being divergent.

6. A circuit board socket as in claim 5 wherein said portion of said body extends from the seam to one of said opposed sides.

7. A circuit board socket formed of conductive metal stock and comprising an elongate, hollow body; and a pair of opposed folded cantilever springs at one end of the body, each spring including first and second arms, said first arms being straight, extending lengthwise from said one end and diverging from each other outwardly of the body, each spring being bent back in a bight of less than 180° toward said one end of the body, each second arm extending from its bight in a bowed length to a flat contact surface in the interior of the body, said pair of cantilever springs being normally stressed so that said flat contact surfaces engage each other within the body.

* * * * *